US011186455B2

(12) United States Patent
Asada et al.

(10) Patent No.: US 11,186,455 B2
(45) Date of Patent: Nov. 30, 2021

(54) SHEET FEED DEVICE AND IMAGE RECORDING APPARATUS

(71) Applicant: BROTHER KOGYO KABUSHIKI KAISHA, Nagoya (JP)

(72) Inventors: Tetsuo Asada, Kuwana (JP); Yoichiro Nishimura, Kitakyushu (JP); Asami Hashimoto, Okazaki (JP); Gakuro Kanazawa, Toyokawa (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 98 days.

(21) Appl. No.: 16/687,844

(22) Filed: Nov. 19, 2019

(65) Prior Publication Data

US 2020/0172355 A1 Jun. 4, 2020

(30) Foreign Application Priority Data

Nov. 30, 2018 (JP) ..... JP2018-225310

(51) Int. Cl.
*B65H 1/26* (2006.01)

(52) U.S. Cl.
CPC ..... *B65H 1/266* (2013.01); *B65H 2405/115* (2013.01); *B65H 2405/111646* (2013.01); *B65H 2405/12* (2013.01); *B65H 2511/11* (2013.01)

(58) Field of Classification Search
CPC .. B65H 1/04; B65H 1/266; B65H 2405/1116; B65H 2405/11164; B65H 2405/111646; B65H 2405/112; B65H 2405/1124; B65H 2405/115; B65H 2405/12; B65H 2511/11
See application file for complete search history.

(56) References Cited

U.S. PATENT DOCUMENTS

2002/0164190 A1* 11/2002 Hill ..... B65H 1/266 400/624
2007/0090589 A1* 4/2007 Takahashi ..... B65H 1/266 271/162
2011/0241286 A1* 10/2011 Ishii ..... B65H 1/266 271/167
2014/0035218 A1* 2/2014 Koyama ..... B65H 33/08 271/3.14
2014/0145392 A1* 5/2014 Tanio ..... B65H 3/56 271/121

FOREIGN PATENT DOCUMENTS

JP 11092011 A * 4/1999 ..... B65H 1/266
JP 2015-123606 A 7/2015

* cited by examiner

*Primary Examiner* — Prasad V Gokhale
(74) *Attorney, Agent, or Firm* — Scully, Scott, Murphy & Presser, P.C.

(57) ABSTRACT

A housing is formed with a first opening and a sheet conveyance path. A tray is inserted into the housing through the first opening in a first direction and pulled out in a second direction opposite from the first direction. The tray supports a sheet. The tray includes a bottom plate, a front plate, and a cover. The bottom plate supports a sheet. The front plate protrudes upward from an end portion of the bottom plate in the second direction. The cover is configured to move between a first position at which the cover closes a second opening and a second position at which the cover opens the second opening. The second opening is defined by an end of a top plate in the second direction and an upper end of the front plate, the top plate covering an upper side of a space that accommodates a sheet.

13 Claims, 10 Drawing Sheets

SHEET FEED DEVICE AND IMAGE RECORDING APPARATUS

CROSS REFERENCE TO RELATED APPLICATIONS

This application claims priority from Japanese Patent Application No. 2018-225310 filed Nov. 30, 2018. The entire content of the priority application is incorporated herein by reference.

TECHNICAL FIELD

This disclosure relates to a sheet feed device configured to convey a sheet, and an image recording apparatus having such sheet feed device and configured to record an image on a sheet.

BACKGROUND

A conventional sheet feed device includes a tray that supports a sheet and conveys the sheet supported on the tray. As an apparatus including such sheet feed device, an image recording apparatus that records an image on a sheet is known, for example.

The tray supports sheets of various sizes. In recent years, the sheet feed device is required to be configured to convey a sheet of a larger size while suppressing an increase in size of the apparatus.

In a known recording apparatus, a cover provided at the front end of the tray is rotatably moved to open. In this recording apparatus, by opening the cover, the tray can support a sheet having a longer front-rear size than the tray.

SUMMARY

According to one aspect, this specification discloses a sheet feed device. The sheet feed device includes a housing and a tray. The housing is formed with a first opening and a sheet conveyance path. The tray is configured to be inserted into the housing through the first opening in a first direction and to be pulled out in a second direction opposite from the first direction. The tray is configured to support a sheet. The tray includes a bottom plate, a front plate, and a cover. The bottom plate is configured to support a sheet. The front plate protrudes upward from an end portion of the bottom plate in the second direction. The cover is configured to move between a first position at which the cover closes a second opening and a second position at which the cover opens the second opening. The second opening is defined by an end of a top plate in the second direction and an upper end of the front plate, the top plate covering an upper side of a space that accommodates a sheet.

According to another aspect, this specification also discloses an image recording apparatus. The image recording apparatus includes a sheet feed device and a print engine. The sheet feed device includes a housing and a tray. The housing is formed with a first opening and a sheet conveyance path. The tray is configured to be inserted into the housing through the first opening in a first direction and to be pulled out in a second direction opposite from the first direction. The tray is configured to support a sheet. The tray includes a bottom plate, a front plate, and a cover. The bottom plate is configured to support a sheet. The front plate protrudes upward from an end portion of the bottom plate in the second direction. The cover is configured to move between a first position at which the cover closes a second opening and a second position at which the cover opens the second opening. The second opening is defined by an end of a top plate in the second direction and an upper end of the front plate, the top plate covering an upper side of a space that accommodates a sheet. The print engine is configured to print an image on a sheet that is conveyed through the sheet conveyance path.

BRIEF DESCRIPTION OF THE DRAWINGS

Embodiments in accordance with this disclosure will be described in detail with reference to the following figures wherein:

FIGS. 4A and 4B are cross-sectional views schematically showing a section A-A of FIG. 3, wherein FIG. 4A shows a state where a cover 51 is at an standing position and FIG. 4B shows a state where the cover 51 is at a lying position;

FIGS. 6A and 6B are cross-sectional views schematically showing a part of the feed tray 20 and a discharge tray 21 of a first modification corresponding to the section A-A of FIG. 3, wherein FIG. 6A shows a state where a cover 151 is at a rear position and FIG. 6B shows a state where the cover 151 is at a front position;

FIGS. 8A and 8B are cross-sectional views schematically showing a part of the feed tray 20 and the discharge tray 21 of a second modification corresponding to the section A-A of FIG. 3, wherein FIG. 8A shows a configuration where a cover 161 is rotatably supported by a front plate 174 and FIG. 8B shows another configuration where a cover 171 is rotatably supported by a bottom plate 71;

FIGS. 10A and 10B are cross-sectional views schematically showing a part corresponding to the section A-A of FIG. 3, wherein FIG. 10A shows a state where a second plate 182 is at a stowed position and FIG. 10B shows a state where the second plate 182 is at a protruding position.

DETAILED DESCRIPTION

In the above-described recording apparatus, when the tray is inserted into and removed from the recording apparatus, a cover of the tray is gripped. The cover is rotatably supported at a main body of the tray. Thus, there is a risk that the cover is damaged, such as a case in which, when the tray is inserted or removed, the cover comes off from the main body of the tray. Further, in the conventional configuration that the entire front plate of the tray becomes a cover that rotatably moves, the size of the cover increases. Hence, the rotational shaft of the cover and an engagement structure such as a bearing that bears the rotational shaft need to be made robustly. In addition, a problem may occur that, due to an impact applied to the tray when the tray drops, the cover separates from the main body of the tray.

In view of the foregoing, an aspect of an object of this disclosure is to provide a sheet feed device configured to reduce a possibility of damage of a cover that opens and closes a tray for supporting a sheet longer than the tray in the front-rear direction when the tray is inserted into and removed from the recording apparatus.

Some aspects of this disclosure will be described while referring to the attached drawings.

In the following description, an upper-lower direction Z is defined in a state where an MFP (multifunction peripheral) 10 is placed in an orientation in which the MFP 10 is intended to be used (the state of FIG. 1), a front-rear direction Y is defined by defining a surface formed with an opening 13 as a front surface 22, and a left-right direction X (an example of a width direction) is defined in a state where the MFP 10 is viewed from the front. The upper-lower direction Z, the front-rear direction Y, and the left-right direction X are perpendicular to each other.

[Overall Structure of MFP 10]

Figure 1:
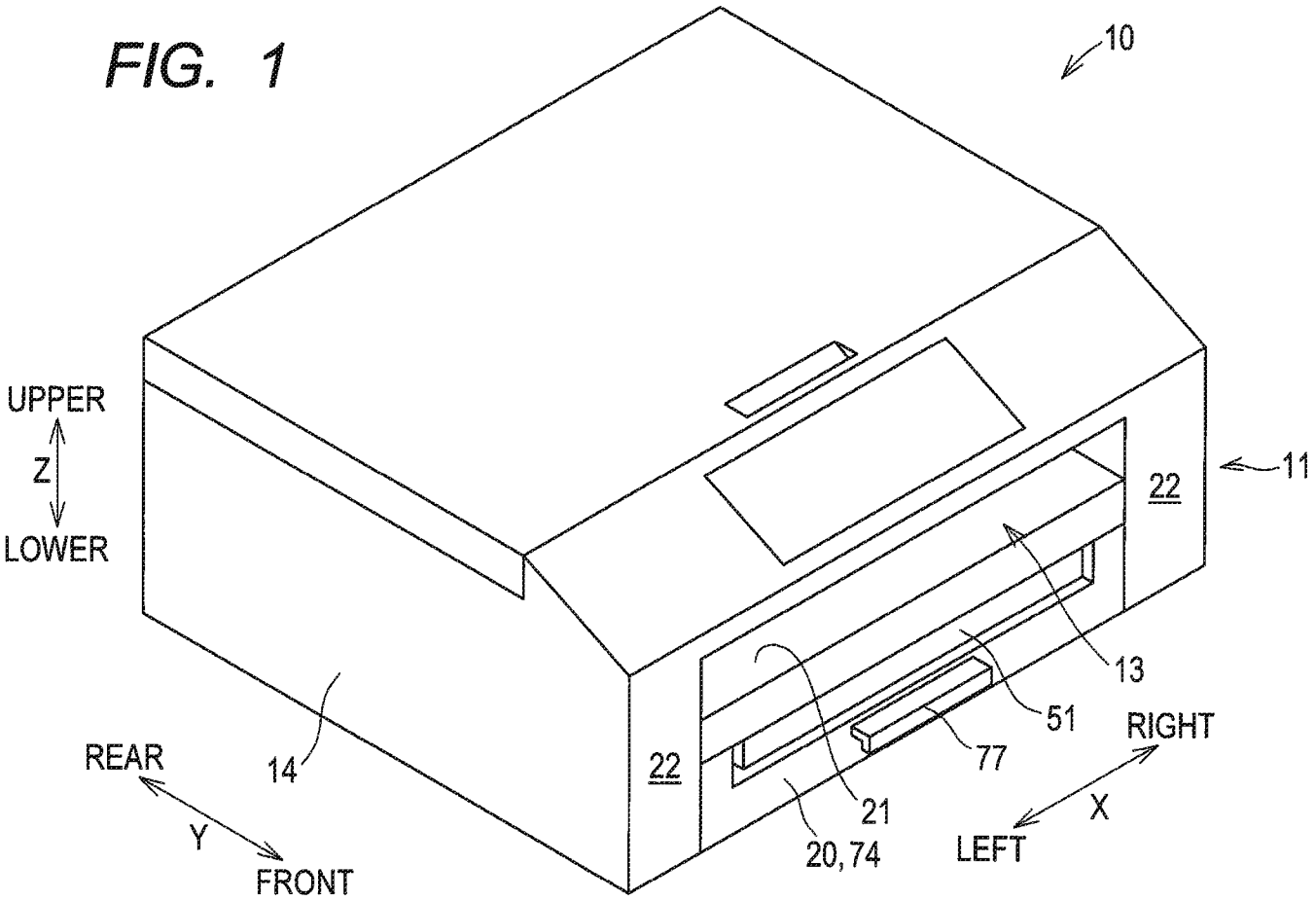
FIG. 1 is a perspective view of an MFP 10.

As shown in FIG. 1, the MFP 10 (an example of an image recording apparatus) is substantially formed as a thin rectangular parallelepiped.

The MFP 10 includes a printer unit 11 at a lower part thereof. The printer unit 11 records an image on paper 15 (an example of a sheet, see FIG. 2). The printer unit 11 includes a sheet feed device and a recording unit 24.

Figure 2:
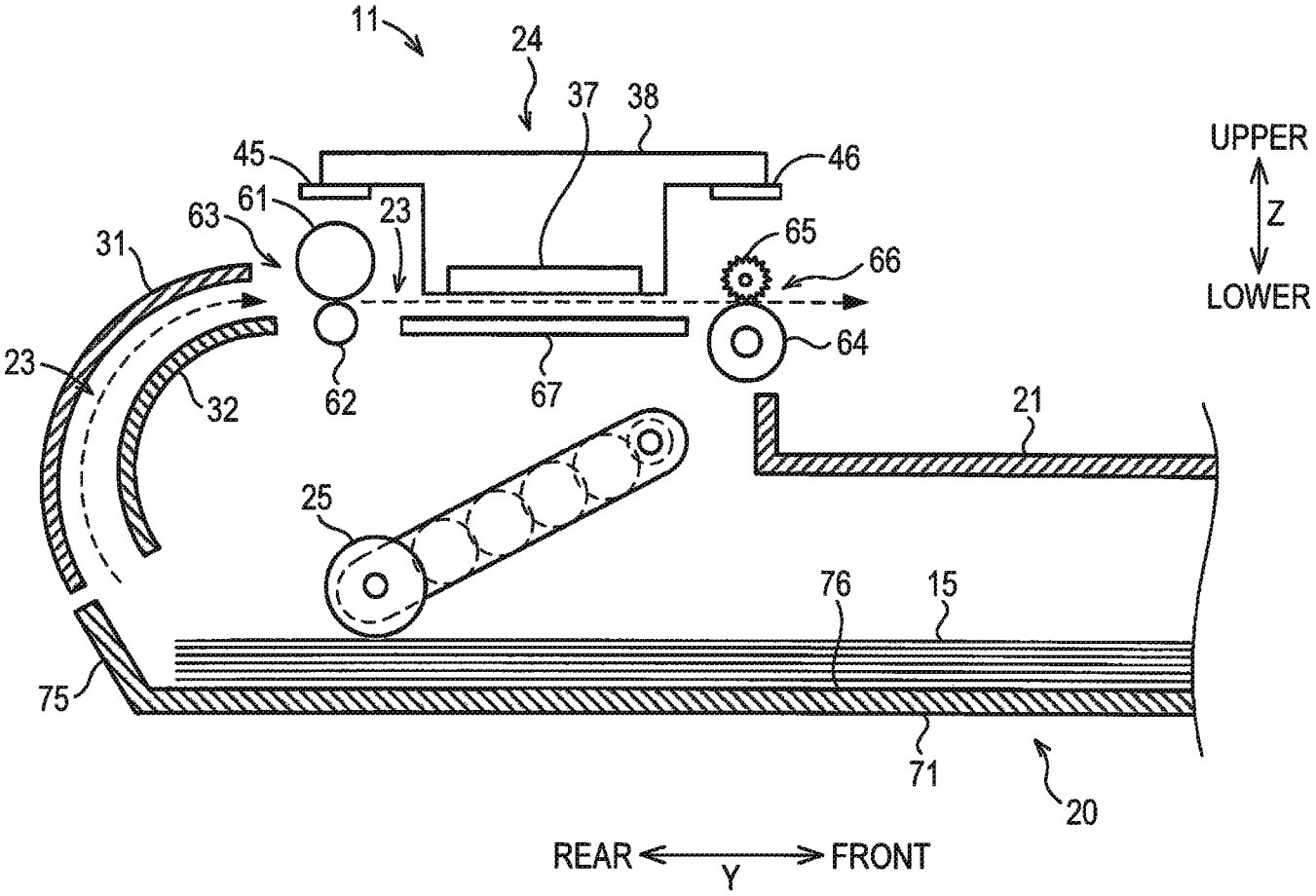
FIG. 2 is a vertical cross-sectional view schematically showing the internal structure of a printer unit 11.

The sheet feed device includes a housing 14 shown in FIG. 1, a feed tray 20 (an example of a tray) shown in FIG. 2, a discharge tray 21, a feed roller 25, a pair of conveyance rollers 63, and a pair of discharge rollers 66.

The housing 14 has substantially a rectangular-parallelepiped box shape. The housing 14 has an internal space. As shown in FIG. 2, a conveyance path 23 is formed in the internal space of the housing 14. The feed roller 25, the pair of conveyance rollers 63, the pair of discharge rollers 66, the recording unit 24, and so on are arranged in the internal space of the housing 14.

The conveyance path 23 is a path through which paper 15 passes. The feed roller 25 feeds, to the conveyance path 23, paper 15 supported on an upper surface 76 (an example of a sheet support surface) of a bottom plate 71 of the feed tray 20. The feed roller 25 is driven by receiving driving force of a feed motor (not shown). The pair of conveyance rollers 63 and the pair of discharge rollers 66 are arranged on the conveyance path 23. The pair of conveyance rollers 63 and the pair of discharge rollers 66 convey paper 15 that is fed to the conveyance path 23 by the feed roller 25. The recording unit 24 records an image on paper 15 by an inkjet method.

As shown in FIG. 1, the opening 13 (an example of a first opening) is formed in the front surface 22 of the housing 14. The feed tray 20 is configured to be inserted rearward into the housing 14 through the opening 13 and mounted onto the housing 14. The feed tray 20 is configured to be pulled out forward from the housing 14 through the opening 13. The rearward direction is an example of a first direction, and the forward direction is an example of a second direction.

In the present embodiment, the feed tray 20 is configured to be removed from the housing 14. Here, the feed tray 20 may be configured not to be removed from the housing 14 (more specifically, the feed tray 20 can be pulled to a particular position but cannot be pulled farther than that position).

As shown in FIG. 2, the feed tray 20 supports paper 15 of a desired size. FIGS. 1 and 2 show a state where the feed tray 20 is mounted on the housing 14. The detailed configuration of the feed tray 20 will be described later.

The discharge tray 21 is located above the feed tray 20. The discharge tray 21 supports paper 15 on which an image is recorded and that is discharged from the housing 14. The discharge tray 21 is supported by the housing 14. That is, the feed tray 20 is configured to move relative to the discharge tray 21. Alternatively, the discharge tray 21 may be supported by the feed tray 20 and may be configured to move together with the feed tray 20. The discharge tray 21 is an example of a top plate. The discharge tray 21 covers an upper side of a space that accommodates paper 15.

[Conveyance Path 23]

As shown in FIG. 2, the conveyance path 23 is a path that starts from a rear end portion of the feed tray 20 mounted on the housing 14, extends upward from below while making a U-turn, extends forward to pass below the recording unit 24, and reaches the discharge tray 21. The conveyance path 23 is a space formed by a first guide member 31 and a second guide member 32 facing each other with a particular interval, the pair of conveyance rollers 63, the recording unit 24 and a platen 67 facing each other with a particular interval, and the pair of discharge rollers 66. The paper 15 fed by the feed roller 25 is conveyed through the conveyance path 23 in a conveyance direction that is indicated by the dashed arrow in FIG. 2.

[Pair of conveyance rollers 63 and pair of discharge rollers 66]

As shown in FIG. 2, the pair of conveyance rollers 63 is arranged on the conveyance path 23. The pair of conveyance rollers 63 includes a conveyance roller 61 and a pinch roller 62. The pinch roller 62 is in pressure contact with the conveyance roller 61 due to an elastic member such as a spring (not shown). With this configuration, the pair of conveyance rollers 63 is configured to nippingly hold paper 15.

The pair of discharge rollers 66 is arranged at the downstream side of the pair of conveyance rollers 63 in the conveyance direction along the conveyance path 23. The pair of discharge rollers 66 includes a discharge roller 64 and a spur 65. The spur 65 is in pressure contact with the discharge roller 64 due to an elastic member such as a spring (not shown). With this configuration, the pair of discharge rollers 66 is configured to nippingly hold paper 15.

The conveyance roller 61 and the discharge roller 64 are driven by receiving driving force of a conveyance motor (not shown). The conveyance roller 61 to which driving force is transmitted nippingly holds paper 15 with the pinch roller 62 therebetween and conveys the paper 15 in the conveyance direction. The discharge roller 64 to which driving force is transmitted nippingly holds paper 15 with the spur 65 therebetween and conveys the paper 15 in the conveyance direction.

[Recording Unit 24]

As shown in FIG. 2, the recording unit 24 is disposed between the pair of conveyance rollers 63 and the pair of discharge rollers 66 on the conveyance path 23. The recording unit 24 includes a recording head 37 and a carriage 38. The recording head 37 ejects ink droplets by an inkjet method. The recording head 37 is mounted on the carriage 38. The carriage 38 is supported by guide rails 45 and 46 so as to move along the left-right direction X perpendicular to the conveyance direction of paper 15. The guide rails 45 and 46 are supported by the housing 14. The carriage 38 moves by receiving driving force of a carriage drive motor (not shown).

The recording head 37 is disposed at a lower part of the carriage 38. The lower surface of the recording head 37 is formed with a plurality of nozzles (not shown). The nozzles are exposed on the lower surface of the carriage 38. The nozzles eject ink droplets toward the platen 67 located below. The platen 67 is disposed below the recording head 37 so as to face the recording head 37. The platen 67 has substantially a flat plate shape, and is configured to support paper 15 on the upper surface thereof.

In the housing 14, ink tanks of each color (for example, black, yellow, cyan, and magenta) (not shown) are arranged. The ink tanks may be mounted on the carriage 38. Ink of each color is supplied from the ink tanks to the recording head 37. While the carriage 38 moves along the left-right direction X, ink of each color is selectively ejected from each nozzle as small ink droplets. With this configuration, an image is recorded on paper 15 located on the platen 67.

[Feed Tray 20]

Figure 3:
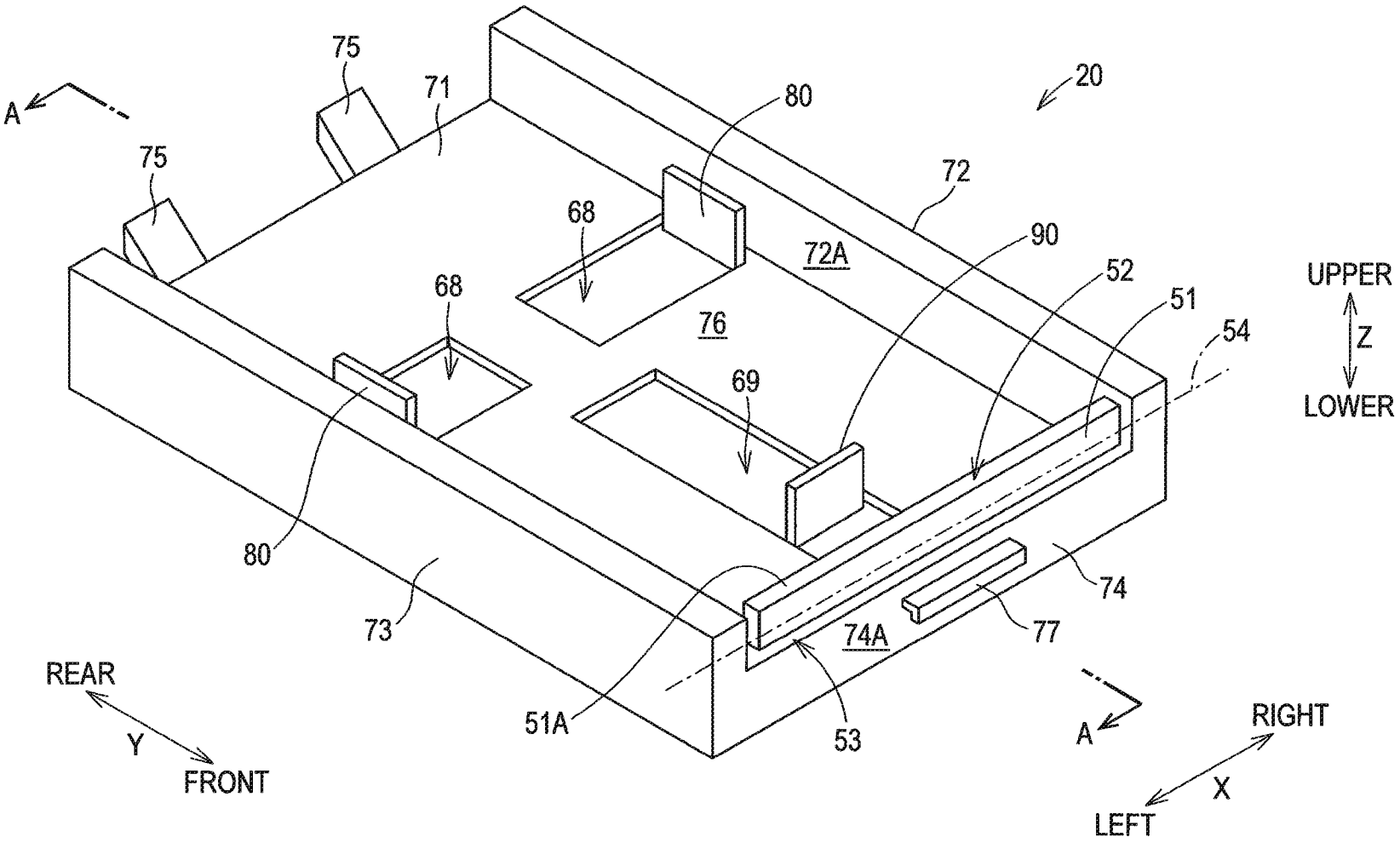
FIG. 3 is a perspective view of a feed tray 20.

As shown in FIG. 3, the feed tray 20 has substantially a rectangular-parallelepiped box shape. The upper side of the feed tray 20 is opened. The length of the feed tray 20 in the upper-lower direction Z is shorter than the length of the feed tray 20 in the left-right direction X and the length of the feed tray 20 in the front-rear direction Y. The feed tray 20 includes the bottom plate 71, side plates (a right plate 72, a left plate 73, and a front plate 74), stoppers 75, and a cover 51.

The bottom plate 71 has the upper surface 76 on which paper 15 is supported. The upper surface 76 is a surface extending in the front-rear direction Y and in the left-right direction X.

The right plate 72 is provided to stand at the right end portion of the bottom plate 71. The right plate 72 extends in the front-rear direction Y. The left plate 73 is provided to stand at the left end portion of the bottom plate 71. The left plate 73 extends in the front-rear direction Y. The right plate 72 and the left plate 73 face each other in the left-right direction X.

The front plate 74 is provided to stand at the front end portion of the bottom plate 71. The front plate 74 extends in the left-right direction X. The upper end of the front plate 74 is located at a lower position than the upper end of the right plate 72 and the upper end of the left plate 73. The front plate 74 is fixed to the bottom plate 71. That is, the front plate 74 does not move relative to the bottom plate 71. The front plate 74 constitutes a part of the frame of the feed tray 20.

The stoppers 75 are provided to extend diagonally rearward from the rear end portion of the bottom plate 71. At least one (two in the present embodiment) stopper 75 is arranged with intervals therebetween in the left-right direction X. The stoppers 75 are configured to contact the rear end of paper 15 (the leading end of paper 15 when the paper 15 is conveyed) having a size that is set as a supportable size on the upper surface 76 in the MFP 10. With this configuration, in a state where the feed tray 20 is removed through the opening 13, the stoppers 75 stop rearward movement of paper 15 supported on the upper surface 76. This prevents the paper 15 from dropping from the rear end of the feed tray 20.

The cover 51 is located above the front plate 74. The cover 51 extends in the left-right direction X. The cover 51 is rotatably supported by the front end portion of the right plate 72 and the front end portion of the left plate 73. The configuration of the cover 51 will be described in detail.

A pair of side guides 80 is supported at the upper surface 76 of the bottom plate 71 so as to be movable in the left-right direction X. The pair of side guides 80 protrudes upward from the upper surface 76. Each of the pair of side guides 80 is configured to move along a groove 68 formed in the upper surface 76. The pair of side guides 80 is arranged to face each other in the left-right direction X. Both of left and right ends of paper 15 supported on the upper surface 76 contact the side surface of each of the pair of side guides 80. When one of the pair of side guides 80 moves rightward or leftward, the other one of the pair of side guides 80 interlockingly moves in the opposite direction of rightward or leftward. With this configuration, paper 15 is positioned in the center of the upper surface 76 in the left-right direction X.

Regarding the configuration by which the pair of side guides 80 is movably supported by the bottom plate 71, a known configuration may be adopted. Further, only one side guide may be provided instead of the pair of side guides 80. In this case, the side guide contacts the right end or the left end of paper 15 supported on the upper surface 76 to position the paper 15 to the left end or the right end.

A rear guide 90 is supported on the upper surface 76 of the bottom plate 71 so as to be movable in the front-rear direction Y. The rear guide 90 protrudes upward from the upper surface 76. The rear guide 90 is located at a farther rearward position than the front plate 74. In the present embodiment, the rear guide 90 is located at the center portion of the upper surface 76 in the left-right direction X, but may be located at a position other than the center portion. The rear guide 90 is configured to move along a groove 69 formed in the upper surface 76. The rear guide 90 contacts the front end of paper 15 (the trailing end of paper 15 when the paper 15 is conveyed) supported on the upper surface 76. With this configuration, the front end of paper 15 is positioned. Regarding the configuration in which the rear guide 90 is movably supported by the bottom plate 71, a known configuration may be adopted.

The front plate 74 includes a grip portion 77 at a front surface 74A thereof. The grip portion 77 is gripped when the feed tray 20 is inserted into and removed from the housing 14. The grip portion 77 is an example of a grip for inserting and pulling the tray 20 relative to the housing 14. In the present embodiment, the grip portion 77 is a protrusion that protrudes from the front surface 74A. In the present embodiment, the grip portion 77 is located at the center portion of the front surface 74A in the left-right direction X, but may be located at a position other than the center portion. Alternatively, instead of the protrusion, for example, a concave portion that is concaved rearward from the front surface 74A may be formed in the front surface 74A, or a through hole penetrating the front plate 74 in the front-rear direction Y may be formed in the front plate 74. In a case where the concave portion is provided, each surface constituting (defining) the concave portion serves as the grip. In a case where the through hole is provided, each surface constituting (defining) the through hole serves as the grip.

Figure 4A:
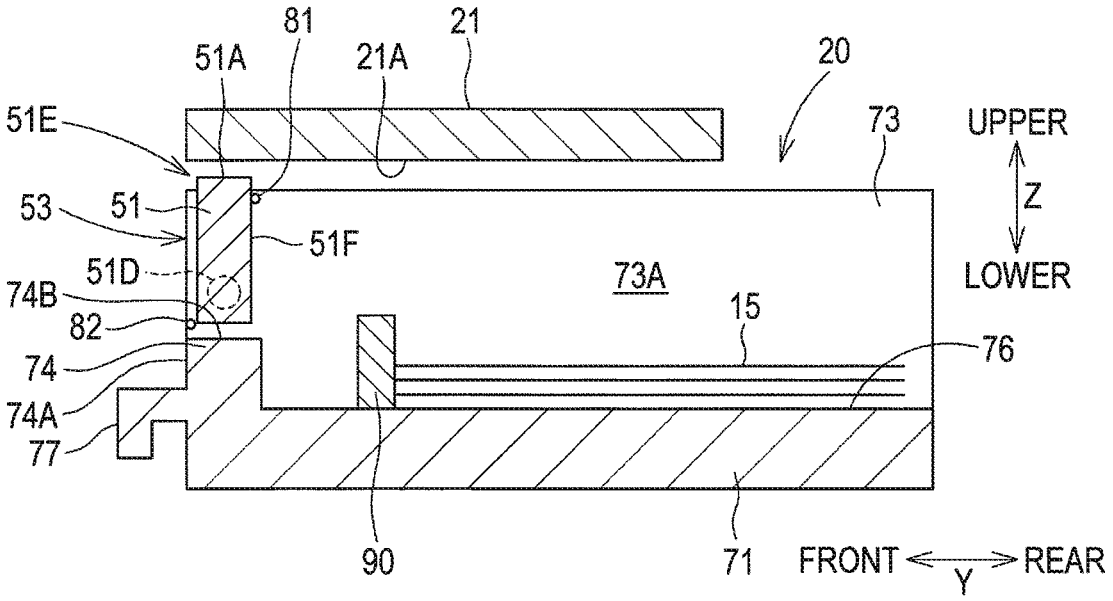
Figure 4B:
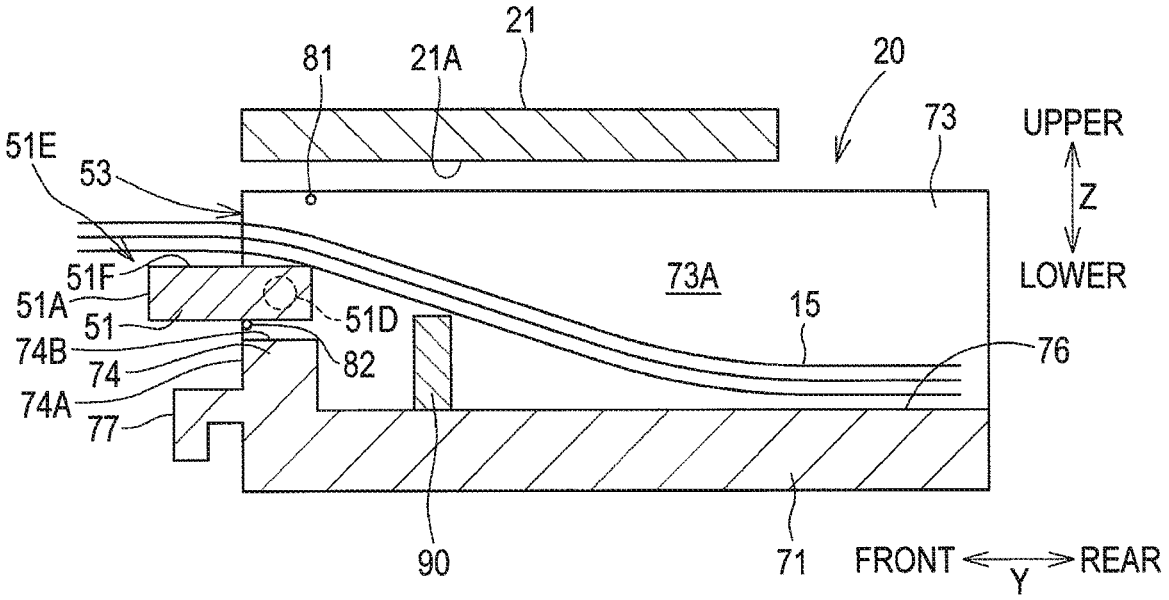

As shown in FIGS. 4A and 4B, the cover 51 includes protrusions 51D that protrude in the left-right direction X from the lower end portions of the right surface and the left surface of the cover 51. The protrusions 51D are inserted in holes (not shown) formed in the right plate 72 and the left plate 73. With this configuration, as described above, the cover 51 is rotatably supported by the front end portion of the right plate 72 and the front end portion of the left plate 73.

The cover 51 is configured to rotatably move about an axis 54 between a standing position (an example of a second position) shown in FIGS. 1, 3, and 4A and a lying position (an example of a first position) shown in FIG. 4B. As shown by the single-dot chain line in FIG. 3, the axis 54 is a line passing through the center of the protrusions 51D and extending in the left-right direction X. The axis 54 is located at the lower end portion of the cover 51.

As shown in FIG. 4A, in a state where the cover 51 is located at the standing position, the cover 51 extends upward (vertically) from the upper end portion of the front plate 74. In a state where the cover 51 is located at the standing position, an upper surface 51A of the cover 51 extends in the front-rear direction Y and in the left-right direction X and faces upward.

Only a small gap is formed between the upper surface 51A of the cover 51 at the standing position and a lower surface 21A of the discharge tray 21. The gap may be zero. That is, in a state where the cover 51 is located at the standing position, the cover 51 closes an opening 53 (an example of a second opening) located above the front plate 74. The lower end of the opening 53 is defined by an upper surface 74B of the front plate 74, the upper end of the opening 53 is defined by the lower surface 21A (more specifically, the front end portion of the lower surface 21A) of the discharge tray 21, the right end of the opening 53 is defined by a left surface 72A (see FIG. 3) of the right plate 72, and the left end of the opening 53 is defined by a right surface 73A of the left plate 73.

As shown in FIG. 4B, in a state where the cover 51 is located at the lying position, the cover 51 extends forward (horizontally) from the upper end of the front plate 74. A distal end 51E of the cover 51 at the lying position (see FIG. 4B) is located at a farther forward and lower position than the distal end 51E of the cover 51 at the standing position (see FIG. 4A). That is, the cover 51 rotatably moves forward and downward when the cover 51 moves from the standing position to the lying position. In a state where the cover 51 is located at the lying position, the upper surface 51A extends in the upper-lower direction Z and in the left-right direction X and faces forward.

The gap between the surface of the cover 51 facing upward at the lying position (a rear surface 51F of the cover 51) and the lower surface 21A of the discharge tray 21 is larger than the gap between the surface of the cover 51 facing upward at the standing position (the upper surface 51A of the cover 51) and the lower surface 21A of the discharge tray 21. That is, in a state where the cover 51 is located at the lying position, the cover 51 opens the opening 53.

As shown in FIGS. 4A and 4B, the feed tray 20 includes stoppers 81, 82. The stopper 81 contacts the cover 51 at the standing position to prevent the cover 51 at the standing position from rotatably moving clockwise in FIG. 4A (in other words, prevents the cover 51 at the standing position from rotatably moving in the direction away from the lying position). The stopper 82 contacts the cover 51 at the lying position to prevent the cover 51 at the lying position from rotatably moving counter-clockwise in FIG. 4B (in other words, prevents the cover 51 at the lying position from rotatably moving in the direction away from the standing position).

Regarding the configuration by which the cover 51 is rotatably supported, a known configuration may be adopted, not limited to the above-described configuration. For example, the configuration of rotatably supporting the cover 51 may be any member constituting the feed tray 20, and may be the front plate 74 instead of the right plate 72 and the left plate 73.

Figure 5A:
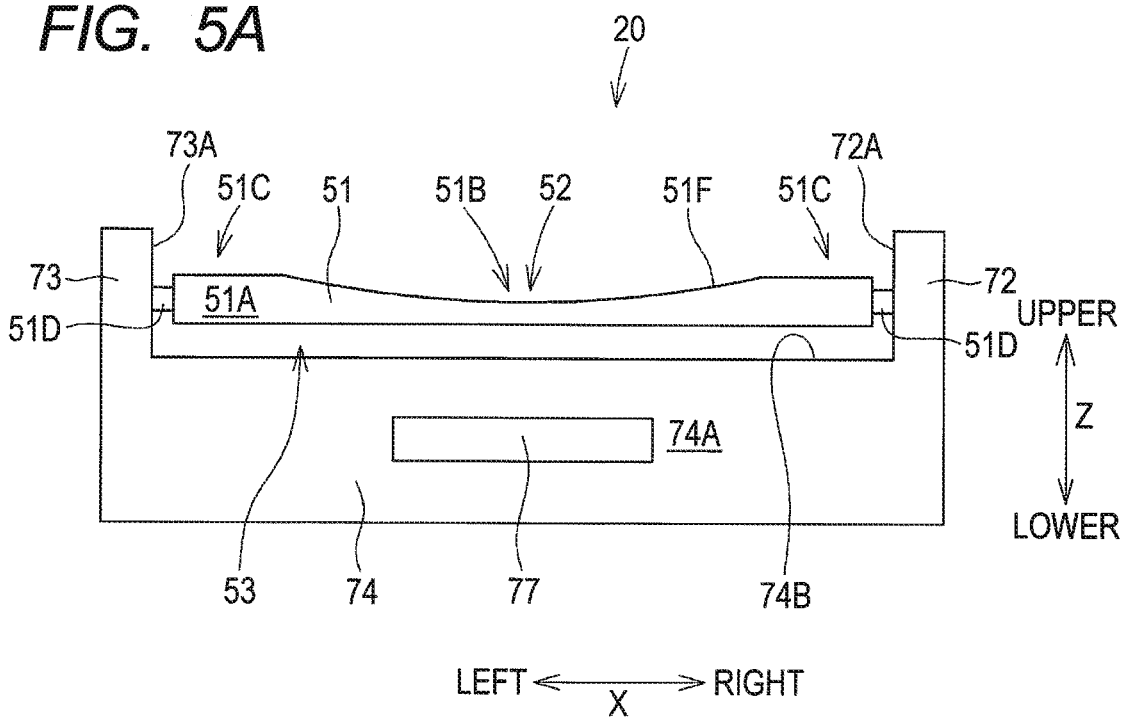
FIG. 5A is a front view of the feed tray 20 in the state of FIG. 4B.
Figure 5B:
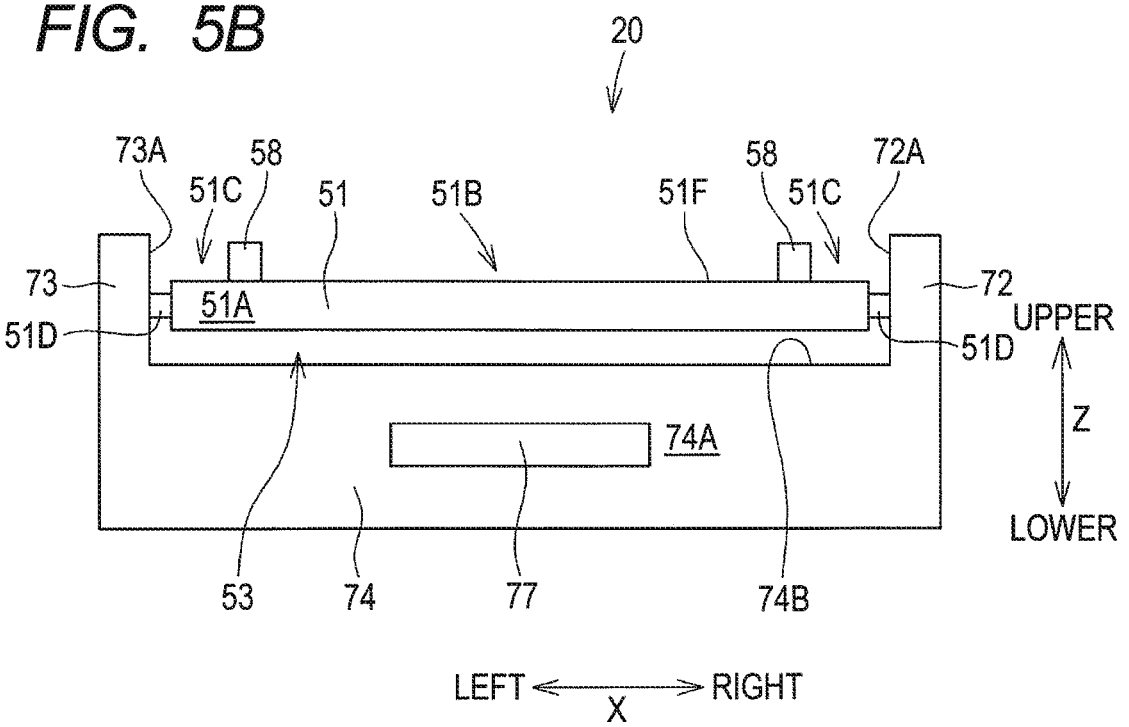
FIG. 5B is a front view of the feed tray 20 in the state of FIG. 4B according to another example.

As shown in FIG. 5A, the cover 51 has a concave portion 52 at a center portion 51B of the rear surface 51F in the left-right direction X. With this configuration, the center portion 51B of the rear surface 51F in the left-right direction X is located at a lower position than both end portions 51C of the rear surface 51F in the left-right direction X. Here, a configuration other than the concave portion 52 may be adopted for realizing the configuration in which the center portion 51B of the rear surface 51F in the left-right direction X is located at a lower position than both end portions 51C of the rear surface 51F in the left-right direction X. For example, instead of the concave portion 52, as shown in FIG. 5B, the cover 51 may include protruding portions 58 such as ribs that protrude upward from the both end portions 51C of the rear surface 51F in the left-right direction X and that extend in the front-rear direction Y.

As shown in FIG. 2, in a state where the feed tray 20 is inserted into the housing 14 through the opening 13 and is mounted on the housing 14, paper 15 supported on the feed tray 20 can be fed to the conveyance path 23.

In a state where a part or an entirety of the feed tray 20 is pulled out from the housing 14 through the opening 13 (for example, as shown in FIG. 3, a state where the entirety of the feed tray 20 is pulled out), paper 15 can be replenished onto the feed tray 20. Even when the feed tray 20 is not pulled out from the housing 14, as shown in FIG. 4B, paper 15 can be replenished onto the feed tray 20 by rotatably moving the cover 51 to the lying position.

As shown in FIG. 4A, in a case where paper 15 having a shorter length than the upper surface 76 in the front-rear direction Y is supported on the upper surface 76, the paper 15 is positioned by the rear guide 90. In this case, the cover 51 is located at the standing position. This suppresses entrance of foreign matters to inside the feed tray 20 from the outside.

As shown in FIG. 4B, in a case where paper 15 having a longer length than the upper surface 76 in the front-rear direction Y is supported on the upper surface 76, the cover 51 is located at the lying position. In this case, the rear portion of the paper 15 is supported on the upper surface 76, and the front portion of paper 15 is supported on the rear guide 90 and the rear surface 51F of the cover 51. At this time, the front portion of paper 15 is supported along the concave portion 52 of the rear surface 51F of the cover 51, and thereby becomes convex downward with respect to the left-right direction X. This suppresses hanging down of a part of paper 15 located farther forward than the cover 51.

[Effects of Embodiment]

In the present embodiment, the feed tray 20 can be inserted into and removed from the housing 14 by gripping the front plate 74 (more specifically, the grip portion 77) formed integrally with the bottom plate 71. That is, it is unnecessary to grip the cover 51 in the inserting and removing process. This lowers a possibility that the cover 51 is damaged in the inserting and removing process. Further, because the size of the cover 51 is reduced and the weight is reduced, the cover 51 is unlikely to come off when an impact is applied to the feed tray 20 due to drop of the feed tray 20 and so on.

The grip portion 77 is provided at the front plate 74 which is a rigid part constituting the frame of the feed tray 20. Thus, when the user grips the grip portion 77, the user feels secure due to rigidity of the grip portion 77.

Further, the cover 51 changes its posture (orientation) when the cover 51 opens and closes, while the front plate 74 does not change its posture. Because the grip portion 77 is provided at the front plate 74 which does not change its posture, the position of the grip portion 77 is unchanged and it is easy for the user to grip the grip portion 77.

In the present embodiment, paper 15 can be supported by the cover 51 located at the lying position.

In the present embodiment, the center portion 51B of the rear surface 51F of the cover 51 in the left-right direction X is located at a lower position that the both end portions 51C of the rear surface 51F of the cover 51 in the left-right direction X. Thus, in a state where a part of paper 15 having a longer length than the bottom plate 71 in the front-rear direction is supported on the cover 51 at the lying position, the paper 15 becomes a curved state that is convex downward. This suppresses hanging down of paper 15 located at farther forward than the cover 51.

In the present embodiment, because the grip portion 77 is provided at the front plate 74, the front plate 74 can be gripped easily.

[First Modification]

In the above-described embodiment, the cover 51 rotatably moves between the standing position shown in FIG. 4A and the lying position shown in FIG. 4B. However, the rotated position of the cover 51 is not limited to the position shown in FIGS. 4A and 4B.

Figure 6A:
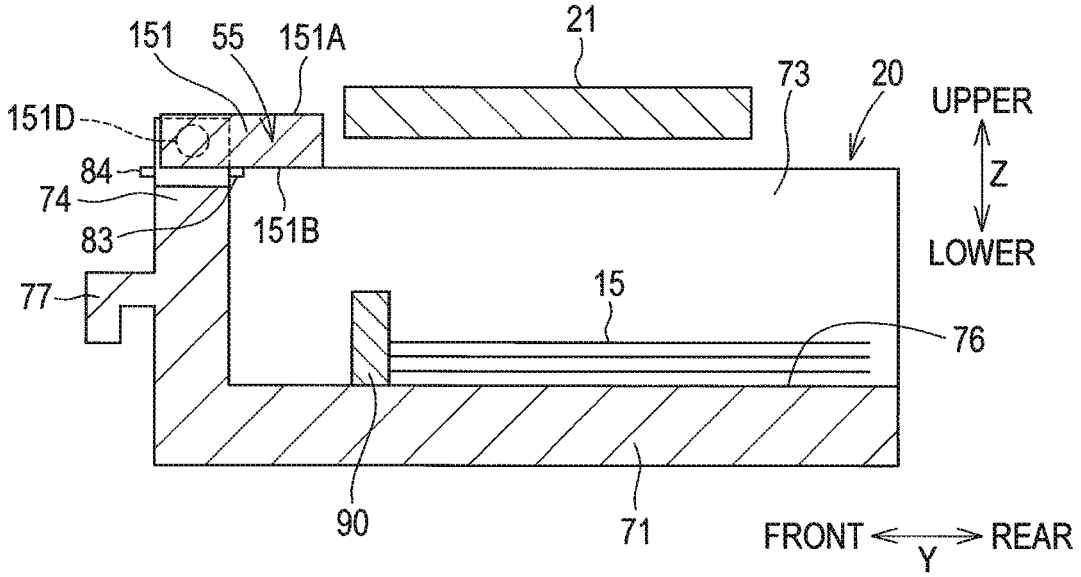
Figure 6B:
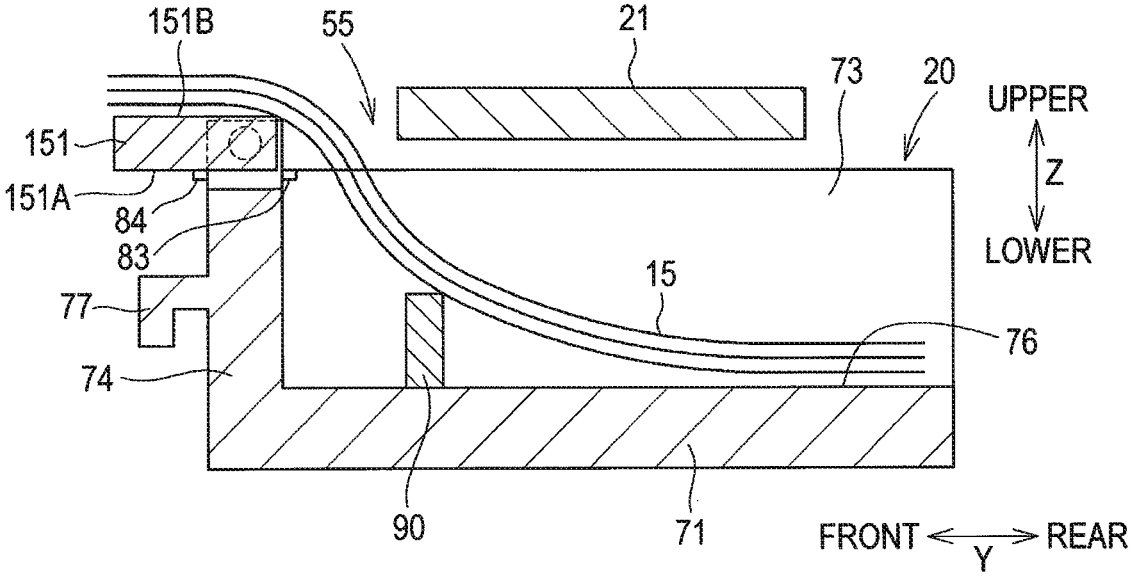

For example, as shown in FIGS. 6A and 6B, instead of the cover 51, the feed tray 20 may include a cover 151 configured to rotatably move between a rear position (an example of the first position) shown in FIG. 6A and a front position (an example of the second position) shown in FIG. 6B about a shaft 151D extending in the left-right direction X.

As shown in FIGS. 6A and 6B, the front end of the discharge tray 21 is located at a farther rearward position than the front plate 74 of the feed tray 20. With this configuration, an opening 55 (an example of the second opening) is formed between the discharge tray 21 and the front plate 74. More specifically, the opening 55 is defined by the front end of the discharge tray 21 and the upper end of the front plate 74.

The cover 151 is rotatably supported by the upper end portion of the front plate 74. Alternatively, the cover 151 may be supported by a member other than the front plate 74.

As shown in FIG. 6A, in a state where the cover 151 is located at the rear position, the cover 151 extends rearward from the upper end portion of the front plate 74. In a state where the cover 151 is located at the rear position, a surface 151A faces upward and is configured to support paper 15 that is discharged from the MFP 10 in cooperation with the discharge tray 21. A surface 151B which is the opposite surface of the surface 151A faces downward.

Only a small gap is formed in the front-rear direction Y between the discharge tray 21 and the cover 151 at the rear position. This gap may be zero. That is, in a state where the cover 151 is located at the rear position, the cover 151 closes the opening 55.

As shown in FIG. 6B, in a state where the cover 151 is located at the front position, the cover 151 extends forward from the upper end portion of the front plate 74. In a state where the cover 151 is located at the front position, the surface 151B faces upward and the surface 151A faces downward.

The gap between the discharge tray 21 and the cover 151 at the front position is larger than the gap between the discharge tray 21 and the cover 151 at the rear position. That is, in a state where the cover 151 is located at the front position, the cover 151 opens the opening 55.

As shown in FIGS. 6A and 6B, the feed tray 20 includes stoppers 83, 84. The stopper 83 is configured to contact the cover 151 at the rear position to prevent the cover 151 at the rear position from rotatably moving clockwise in FIG. 6A (in other words, prevent the cover 151 at the rear position from rotatably moving in the direction away from the front position). The stopper 84 is configured to contact the cover 151 at the front position to prevent the cover 151 at the front position from rotatably moving counter-clockwise in FIG. 6B (in other words, prevent the cover 151 at the front position from rotatably moving in the direction away from the rear position).

Figure 7A:
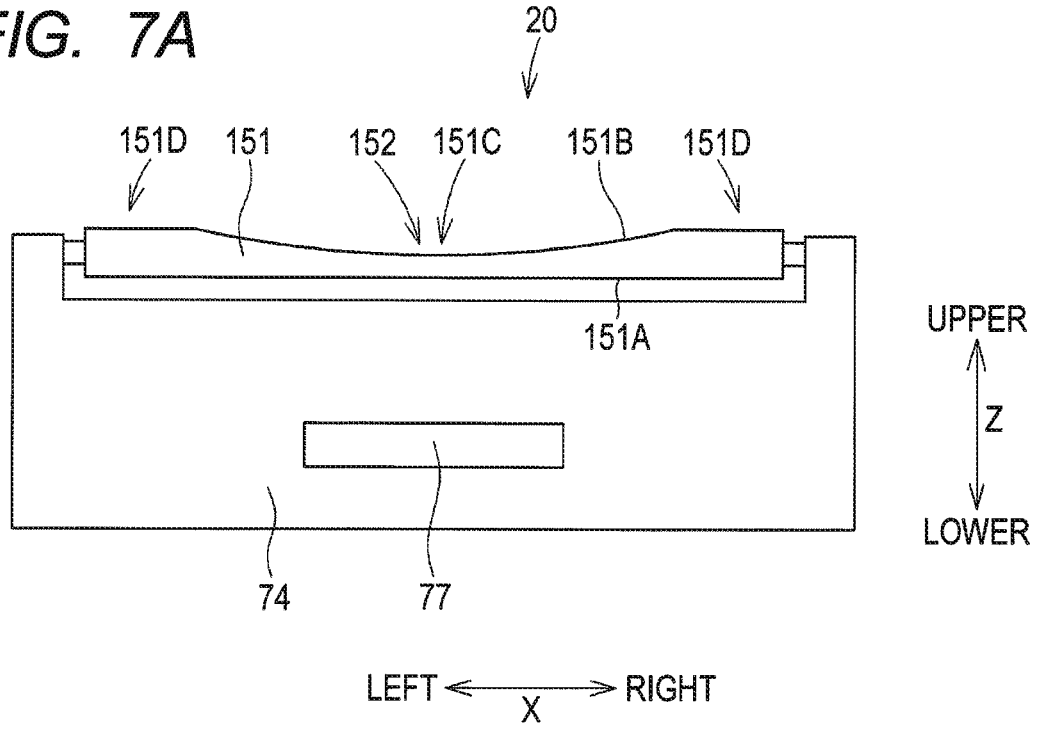
FIG. 7A is a front view of the feed tray 20 in the state of FIG. 6B.
Figure 7B:
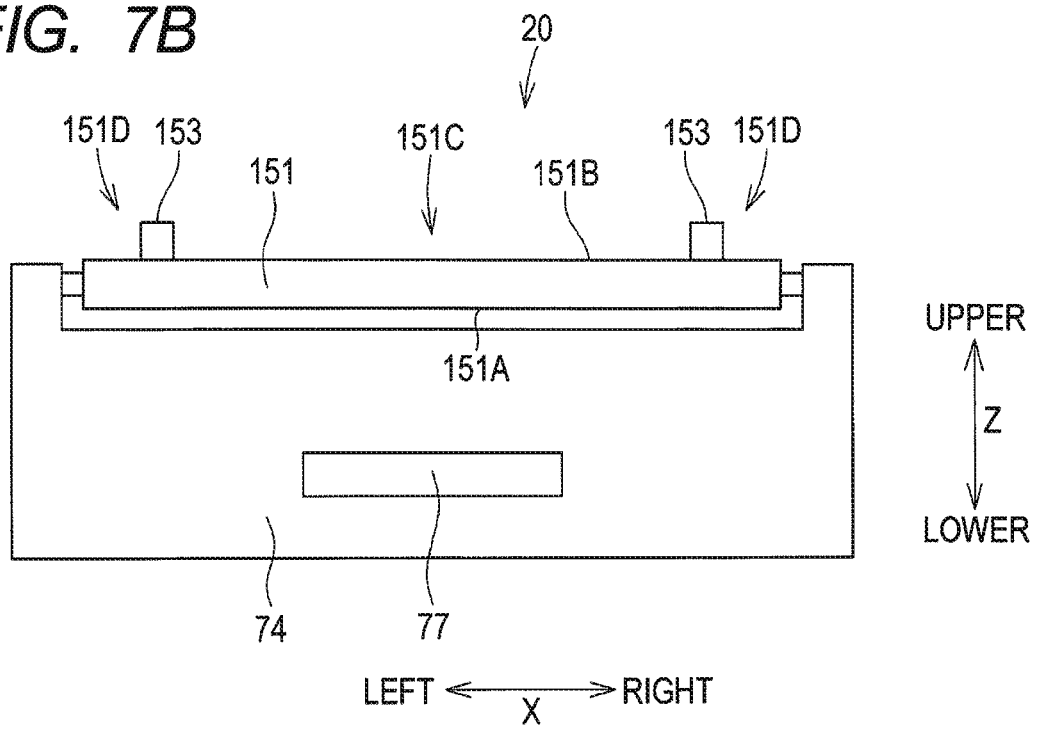
FIG. 7B is a front view of the feed tray 20 in the state of FIG. 6B according to another example.

As shown in FIG. 7A, as in the above-described embodiment, the cover 151 has a concave portion 152 at the center portion of the surface 151B in the left-right direction X. With this configuration, a center portion 151C of the surface 151B in the left-right direction X is located at a lower position than both end portions 151D of the surface 151B in the left-right direction X. Alternatively, a configuration other than the concave portion 152 may be adopted for realizing the configuration in which the center portion 151C of the surface 151B in the left-right direction X is located at a lower position than the both end portions 151D of the surface 151B in the left-right direction X. For example, instead of the concave portion 152, as shown in FIG. 7B, the cover 151 may include protruding portions 153 such as ribs that protrude upward from the both end portions 151D of the surface 151B in the left-right direction X and that extend in the front-rear direction Y.

As shown in FIG. 6A, in a case where paper 15 having a shorter length than the upper surface 76 in the front-rear direction Y is supported on the upper surface 76, the paper 15 is positioned by the rear guide 90. In this case, the cover 151 is located at the rear position. This suppresses entrance of foreign matters to inside the feed tray 20 from the outside.

As shown in FIG. 6B, in a case where paper 15 having a longer length than the upper surface 76 in the front-rear direction Y is supported on the upper surface 76, the cover 151 is located at the front position. In this case, the rear portion of the paper 15 is supported on the upper surface 76, and the front portion of the paper 15 is supported by the rear guide 90 and the surface 151B of the cover 151. At this time, the front portion of the paper 15 is supported along the concave portion 152 of the surface 151B of the cover 151, and thereby becomes convex downward with respect to the left-right direction X. This suppresses hanging down of a part of paper 15 located farther forward than the cover 151.

In the first modification, the cover 151 at the rear position covers the front end portion of the bottom plate 71 from above.

[Second Modification]

In the above-described embodiment, the cover 51 has thickness similar to thickness of the front plate 74, and has a function of preventing an outside foreign matter from entering inside and also a function of supporting paper 15. Alternatively, the feed tray 20 may include a cover 161 having a function of preventing an outside foreign matter from entering inside but not having a function of supporting paper 15 by itself.

Figure 8A:
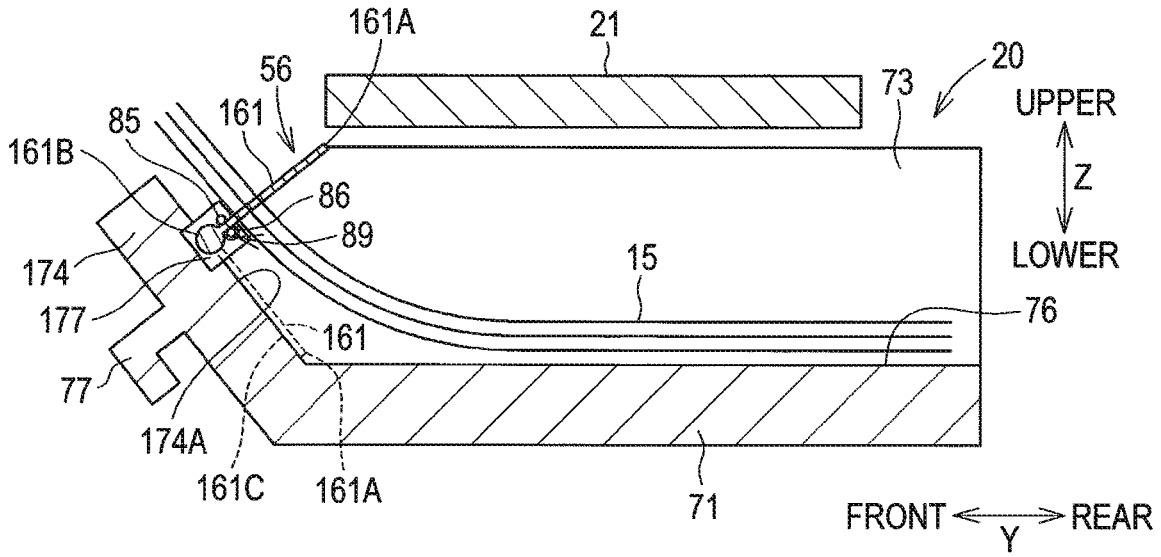
Figure 8B:
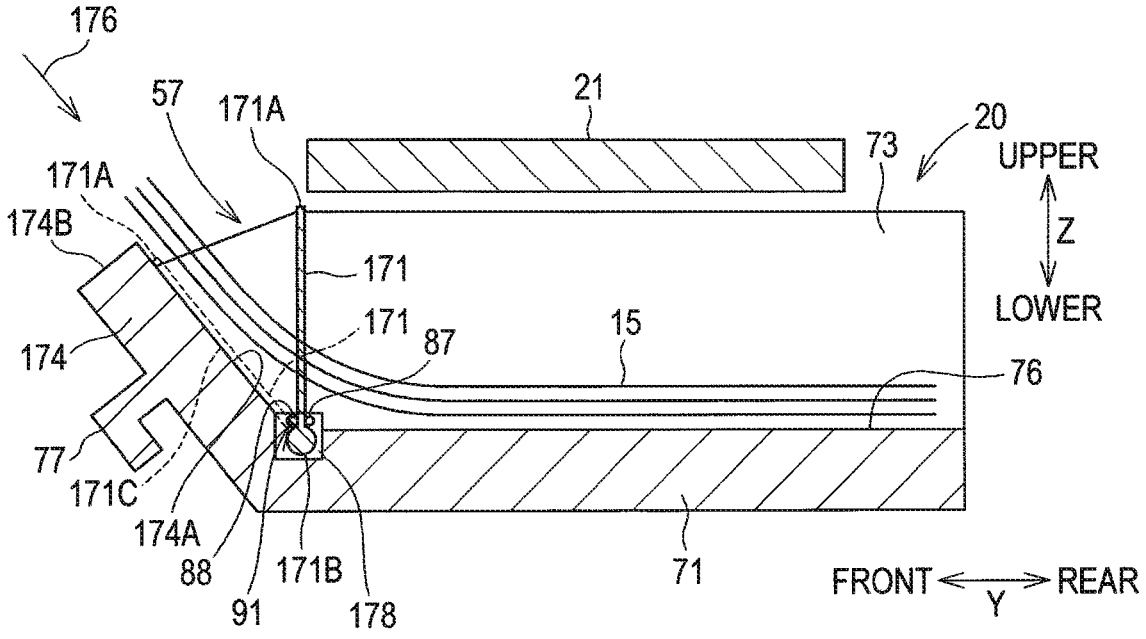

For example, as shown in FIGS. 8A and 8B, the cover 161 may have a thinner shape than the cover 51 shown in FIGS. 4A and 4B and the cover 151 shown in FIGS. 6A and 6B.

In the configuration shown in FIG. 8A, a front plate 174 extends diagonally forward and upward from the bottom plate 71. The cover 161 is rotatably supported by a front portion (a portion closer to a distal end than to a base end) of the front plate 174 so as to be rotatable about a shaft 161B extending in the left-right direction X. The cover 161 is configured to rotatably move between a standing position indicated by the solid lines in FIG. 8A (an example of the first position) and a lying position indicated by the dashed lines in FIG. 8A (an example of the second position).

As indicated by the solid lines in FIG. 8A, in a state where the cover 161 is located at the standing position, the cover 161 extends diagonally rearward and upward from the front portion of the front plate 174. In a state where the cover 161 is located at the standing position, only a small gap is formed between the cover 161 and the discharge tray 21. This gap may be zero. That is, in a state where the cover 161 is located at the standing position, the cover 161 closes an opening 56 between the feed tray 20 and the discharge tray 21. More specifically, the opening 56 is defined by the front end of the discharge tray 21 and the upper end of the front plate 174.

The feed tray 20 includes a lock mechanism configured to hold the cover 161 at the standing position and to release the holding state of the cover 161.

The lock mechanism includes stoppers 85, 86. The stoppers 85, 86 protrude in the left-right direction X from the vicinity of a part of the front plate 174 that supports the cover 161 (a surface 177).

The stopper 85 prevents the cover 161 at the standing position from rotatably moving counter-clockwise in FIG. 8A (in other words, prevents the cover 161 at the standing position from rotatably moving in the direction away from the lying position).

The stopper 86 is configured to move between a protruding position at which the stopper 86 protrudes from a hole 89 formed in the surface 177 and a stowed position at which the stopper 86 is stowed in the hole 89. The stopper 86 is urged toward the protruding position by an urging member such as a coil spring disposed at the hole 89. In a state where the cover 161 is located at the standing position, the stopper 86 is located at the protruding position by being urged by the urging member, and supports the cover 161 at the standing position from below. This configuration prevents the cover 161 at the standing position from rotatably moving clockwise in FIG. 8A (in other words, prevents the cover 161 at the standing position from rotatably moving toward the lying position). When the cover 161 is rotatably moved from the standing position to the lying position by the user, the stopper 86 is pressed by the cover 161 and thereby moves from the protruding position to the stowed position against the urging force of the urging member. With this configuration, the cover 161 is rotatably moved to the lying position.

As indicated by the dashed lines in FIG. 8A, in a state where the cover 161 is located at the lying position, the cover 161 extends diagonally rearward and downward from the front portion of the front plate 174. A distal end 161A of the cover 161 at the lying position is located at a lower position than the distal end 161A of the cover 161 at the standing position. The cover 161 at the lying position lies on an upper surface 174A of the front plate 174. A lower surface 161C of the cover 161 at the lying position contacts the upper surface 174A of the front plate 174 from diagonally above.

A gap between the discharge tray 21 and the cover 161 at the lying position is larger than the gap between the discharge tray 21 and the cover 161 at the standing position. That is, in a state where the cover 161 is located at the lying position, the cover 161 opens the opening 56.

In the configuration shown in FIG. 8B, as in the configuration shown in FIG. 8A, the front plate 174 extends diagonally forward and upward from the bottom plate 71. A cover 171 is rotatably supported by the front end portion of the bottom plate 71 so as to be rotatable about a shaft 171B extending in the left-right direction X. Alternatively, the cover 171 may be rotatably supported by a part other than the bottom plate 71, for example, a rear portion of the front plate 174 (a part closer to a base end than to a distal end). The cover 171 is configured to rotatably move between a standing position indicated by the solid lines in FIG. 8B (an example of the first position) and a lying position indicated by the dashed lines in FIG. 8B (an example of the second position).

As indicated by the solid lines in FIG. 8B, in a state where the cover 171 is located at the standing position, the cover 171 extends upward from the front end portion of the bottom plate 71. In a state where the cover 171 is located at the standing position, only a small gap is formed between the cover 171 and the discharge tray 21. This gap may be zero. That is, in a state where the cover 171 is located at the standing position, the cover 171 closes an opening 57 between the feed tray 20 and the discharge tray 21. More specifically, the opening 57 is defined by the front end of the discharge tray 21 and the upper end of the front plate 174.

The feed tray 20 includes a lock mechanism (not shown) configured to hold the cover 171 at the standing position and to release the hold state of the cover 171.

The lock mechanism includes stoppers 87, 88. The stoppers 87, 88 protrude in the left-right direction X from the vicinity of a part of the front plate 174 that supports the cover 171 (a surface 178).

The stopper 87 prevents the cover 171 at the standing position from rotatably moving clockwise in FIG. 8B (in other words, prevents the cover 171 at the standing position from rotatably moving in the direction away from the lying position).

The stopper 88 is configured to move between a protruding position at which the stopper 88 protrudes from a hole 91 formed in the surface 178 and a stowed position at which the stopper 88 is stowed in the hole 91. The stopper 88 is urged toward the protruding position by an urging member such as a coil spring disposed at the hole 91. In a state where the cover 171 is located at the standing position, the stopper 88 is located at the protruding position by being urged by the urging member, and supports the cover 171 at the standing position from below. This configuration prevents the cover 171 at the standing position from rotatably moving counter-clockwise in FIG. 8B (in other words, prevents the cover 171 at the standing position from rotatably moving toward the lying position). When the cover 171 is rotatably moved from the standing position to the lying position by the user, the stopper 88 is pressed by the cover 171 and thereby moves from the protruding position to the stowed position against the urging force of the urging member. With this configuration, the cover 171 is rotatably moved to the lying position.

As indicated by the dashed lines in FIG. 8B, in a state where the cover 171 is located at the lying position, the cover 171 extends diagonally forward and upward from the front end portion of the bottom plate 71. A distal end 171A of the cover 171 at the lying position is located at a farther forward and downward position than the distal end 171A of the cover 171 at the standing position. The cover 171 at the lying position lies on an upper surface 174A of the front plate 174. A lower surface 171C of the cover 171 at the lying position contacts the upper surface 174A of the front plate 174 from diagonally above.

A gap between the discharge tray 21 and the cover 171 at the lying position is larger than the gap between the discharge tray 21 and the cover 171 at the standing position. That is, in a state where the cover 171 is located at the lying position, the cover 171 opens the opening 57.

Figure 9:
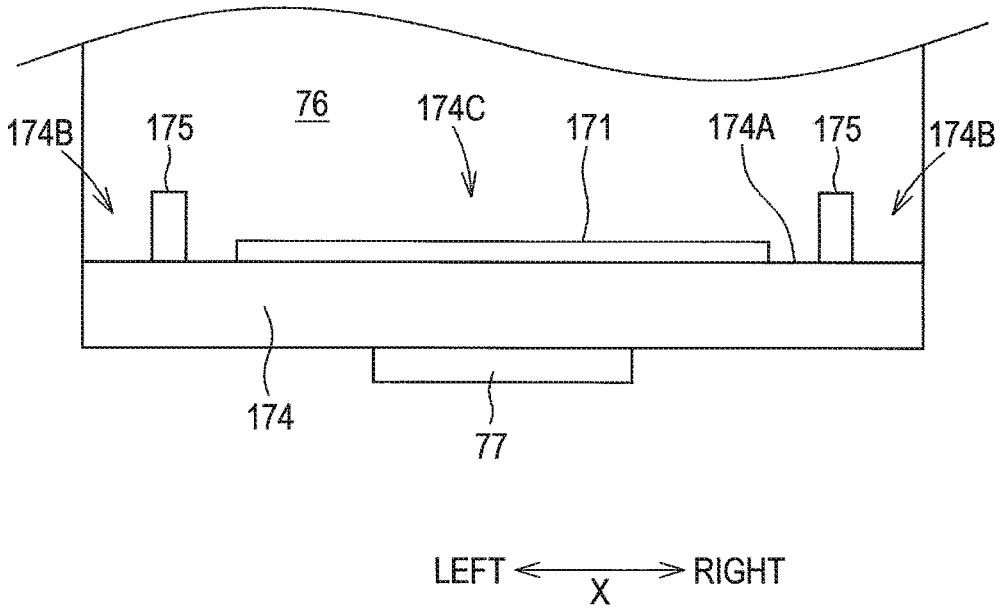
FIG. 9 is a view of the feed tray 20 as viewed in the direction of an arrow 176 in FIG. 8B.

In the configurations shown in FIGS. 8A and 8B, the front plate 174 may be configured such that both end portions of the upper surface 174A in the left-right direction X are located at a higher position than the center portion of the upper surface 174A in the left-right direction X. For example, as shown in FIG. 9, the front plate 174 may include protruding portions 175 such as ribs that protrude upward from both end portions 174B of the upper surface 174A in the left-right direction X. In this case, the upper ends of the protruding portions 175 are located at a higher position than the cover 171 at the lying position that lies on a center portion 174C of the upper surface 174A in the left-right direction X. Alternatively, instead of the protruding portions 175, the front plate 174 may include a concave portion at the center portion 174C of the upper surface 174A in the left-right direction X. In this case, the cover 171 may be curved to be convex downward so as to fit the concave portion when the cover 171 is at the lying position.

In the configuration shown in FIGS. 8A and 8B, in a case where paper 15 having a shorter length than the upper surface 76 in the front-rear direction Y is supported on the upper surface 76, the paper 15 is supported on the upper surface 76. At this time, the cover 161, 171 is located at the standing position. This configuration suppresses entrance of outside foreign matters into the feed tray 20. Note that paper 15 in this case is not shown in FIGS. 8A and 8B.

In the configuration shown in FIGS. 8A and 8B, in a case where paper 15 having a longer length than the upper surface 76 in the front-rear direction Y is supported on the upper surface 76, the cover 161, 171 is located at the lying position. At this time, the rear portion of the paper 15 is supported by the upper surface 76, and the front portion of the paper 15 is supported by the cover 161, 171 and the protruding portions 175 formed on the upper surface 174A of the front plate 174. At this time, the front portion of paper 15 is supported by the cover 161, 171 and the protruding portions 175, and thereby becomes convex downward in the left-right direction X. This suppresses hanging down of the portion of paper 15 located at a farther forward position than the front plate 174.

Here, the feed tray 20 shown in FIGS. 8A and 8B does not include the rear guide 90. Alternatively, the feed tray 20 may include the rear guide 90.

According to the second modification, the cover 161, 171 at the lying position lies on the upper surface 174A of the front plate 174, and is supported by the upper surface 174A. Thus, in a case where the feed tray 20 accommodates paper 15 having a longer front-rear length than the bottom plate 71, a part of the paper 15 is supported on the upper surface 174A of the front plate 174 while the cover 161, 171 is interposed between the paper 15 and the front plate 174. That is, the front plate 174 receives the load of paper 15 that acts on the cover 161, 171. This configuration reduces a possibility that the cover 161, 171 is damaged by the load of the paper 15.

[Third Modification]

Figure 10A:
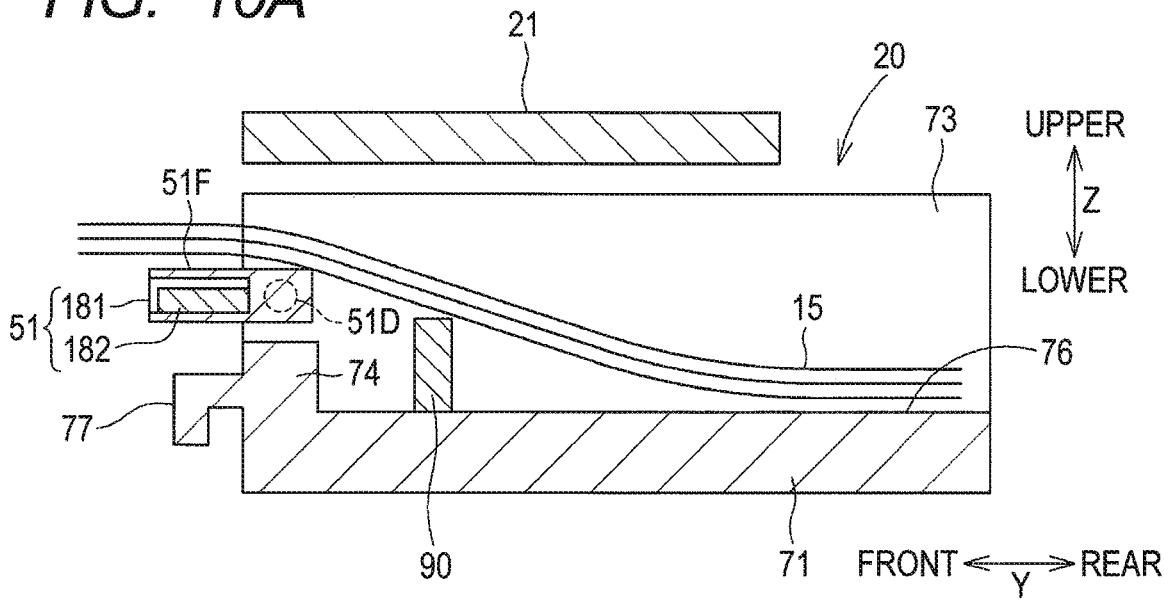
Figure 10B:
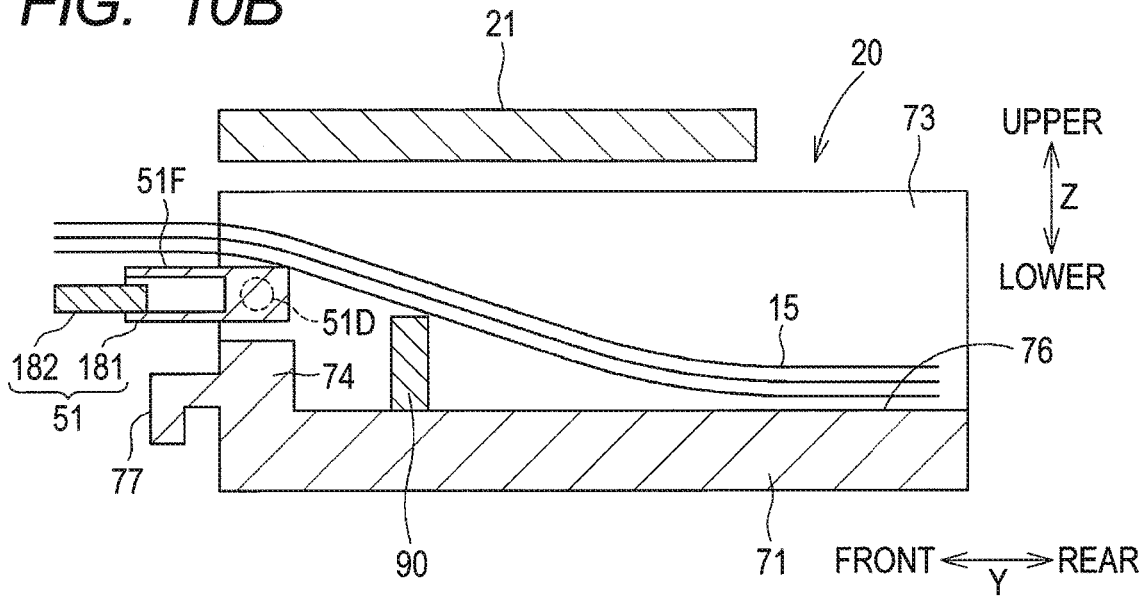

In the configuration shown in FIGS. 4A and 4B, the cover 51 may include a first plate 181 and a second plate 182 (see FIGS. 10A and 10B).

As shown in FIGS. 10A and 10B, as in the cover 51 in FIGS. 4A and 4B, the first plate 181 is rotatably supported by the right plate 72 and the left plate 73 about the protrusions 51D as the center. Here, FIGS. 10A and 10B show a state where the cover 51 is located at the lying position.

The second plate 182 is movably supported by the first plate 181. In the configuration shown in FIGS. 10A and 10B, the second plate 182 is configured to slide between a stowed position shown in FIG. 10A (an example of a third position) and a protruding position shown in FIG. 10B (an example of a fourth position).

A large part of the second plate 182 at the stowed position overlaps the first plate 181 in a plan view of the cover 51.

Only a small part of the second plate 182 at the protruding position overlaps the first plate 181 in a plan view of the cover 51. That is, the overlapping area between the first plate 181 and the second plate 182 at the protruding position in the plan view is smaller than the overlapping area between the first plate 181 and the second plate 182 at the stowed position in the plan view.

Further, a large part of the second plate 182 at the protruding position protrudes from the first plate 181. The second plate 182 protrudes from the distal end of the first plate 181 in the direction away from the rotational center of the first plate 181 along the radial direction of the rotational movement of the first plate 181.

The second plate 182 at the protruding position supports paper 15 in cooperation with the first plate 181.

As the configuration in which the second plate 182 is movably supported by the first plate 181, a known configuration is adopted, such as a configuration in which a protrusion provided at the second plate 182 is guided on a rail provided at the first plate 181, and thereby the second plate 182 is slidably supported by the first plate 181.

As in the above-described embodiment, by providing the concave portion 52 or protrusions, the center portion of the surface in the left-right direction X that faces upward when the cover 51 is located at the lying position may be located at a lower position than the both end portions of the surface in the left-right direction X. In this case, the concave portion 52 or protrusions may be provided at one of the first plate 181 and the second plate 182, or the concave portion 52 or protrusions may be provided at both of the first plate 181 and the second plate 182.

In the above-described configuration, the second plate 182 moves between the stowed position and the protruding position by sliding relative to the first plate 181, but the method of movement of the second plate 182 is not limited to sliding. For example, the second plate 182 may move between the stowed position and the protruding position by rotatably moving relative to the first plate 181.

According to the third modification, when the second plate 182 is located at the protruding position, the cover 51 supports paper 15 with a large surface.

[Other Modification]

While the disclosure has been described in detail with reference to the above aspects thereof, it would be apparent to those skilled in the art that various changes and modifications may be made therein without departing from the scope of the claims.

For example, each of the above-described covers 51, 151, 161, 171 and the first plate 181 of the cover 51 moves to each position by rotational movement. Alternatively, each of the above-described covers 51, 151, 161, 171 and the first plate 181 of the cover 51 may move to each position by a method other than rotational movement, for example, by sliding.

In the above-described embodiment, the recording unit 24 records an image on paper 15 by an inkjet method. Alternatively, the recording unit may record an image on paper 15 by a method other than the inkjet method, for example, by an electro-photographic method.

In the above-described embodiment, the sheet feed device is provided at the MFP 10. However, an apparatus including the sheet feed device is not limited to the MFP 10. For example, the sheet feed device may be provided at a printer, a facsimile machine, a scanner, and so on.

What is claimed is:

1. A sheet feed device comprising:

a housing formed with a first opening and a sheet conveyance path; and a tray configured to be inserted into the housing through the first opening in a first direction and to be pulled out in a second direction opposite from the first direction, the tray being configured to support a sheet, the tray comprising:

a bottom plate configured to support a sheet;

a front plate protruding upward from an end portion of the bottom plate in the second direction; and a cover configured to move between a first position at which the cover closes a second opening and a second position at which the cover opens the second opening, the second opening being defined by an end of a top plate in the second direction and an upper end of the front plate, the top plate covering an upper side of a space that accommodates a sheet, wherein the cover at the first position does not overlap the top plate in the first direction.

2. The sheet feed device according to claim 1, wherein the cover is configured to rotatably move about an axis located at a first end portion of the cover, the first end portion being located at a lower end of the cover when the cover is at the first position, the cover further having a second end portion opposite from the first end portion; and wherein the second end portion of the cover at the second position is located at a position shifted downward and in the second direction from a position of the second end portion of the cover at the first position.

3. The sheet feed device according to claim 2, wherein the cover extends vertically when the cover is at the first position, the cover having a first surface facing in the first direction when the cover is at the first position, the cover further having a second surface facing in the second direction when the cover is at the first position;

wherein the cover extends horizontally when the cover is at the second position, the first surface facing upward when the cover is at the second position, the second surface facing downward when the cover is at the second position; and wherein the first surface has at least one of: a concave portion formed at a center portion in a width direction; and protruding portions provided at both end portions in the width direction, the width direction being perpendicular to the first direction and parallel to a sheet support surface of the bottom plate.

4. The sheet feed device according to claim 1, wherein the cover at the first position extends in the first direction from the front plate; and wherein the cover at the second position extends in the second direction from the front plate.

5. The sheet feed device according to claim 4, wherein the cover is configured to rotatably move about a rotational axis located at an upper end of the front plate, the cover having a first surface facing downward when the cover is at the first position, the cover further having a second surface facing upward when the cover is at the first position;

wherein the first surface faces upward when the cover is at the second position, and the second surface faces downward when the cover is at the second position; and wherein the first surface has at least one of: a concave portion formed at a center portion in a width direction; and protruding portions provided at both end portions in the width direction, the width direction being perpendicular to the first direction and parallel to a sheet support surface of the bottom plate.

6. The sheet feed device according to claim 1, wherein the cover includes:

a first plate rotatably supported by the front plate; and a second plate supported by the first plate so as to move between:

a third position at which the second plate overlaps the first plate; and a fourth position at which the second plate protrudes from a distal end of the first plate in a radial direction of rotational movement of the first plate.

7. The sheet feed device according to claim 1, wherein both end portions of a surface of the cover in a width direction are located at a higher position than a center portion of the surface in the width direction, the width direction being perpendicular to the first direction and parallel to a sheet support surface of the bottom plate, the surface facing upward when the cover is at the second position.

8. The sheet feed device according to claim 1, wherein the front plate extends diagonally upward toward the second direction from an end portion of the bottom plate, the end portion of the bottom plate being an end portion in the second direction;

wherein the cover is configured to rotatably move about an axis located at a first end portion of the cover, the cover further having a second end portion opposite from the first end portion;

wherein the second end portion of the cover at the second position is located at a lower position than the second end portion of the cover at the first position; and wherein the cover at the second position lies on an upper surface of the front plate and supported by the upper surface.

9. The sheet feed device according to claim 1, wherein a grip for inserting and pulling the tray relative to the housing is formed at a surface of the front plate facing in the second direction.

10. The sheet feed device according to claim 1, wherein the tray further includes a guide protruding upward from a sheet support surface of the bottom plate;

in a case where a sheet having a shorter length than the sheet support surface in the first direction is supported on the sheet support surface, the cover is located at the first position and the sheet is positioned by the guide due to contact between the guide and an end of the sheet in the second direction; and in a case where a sheet having a longer length than the sheet support surface in the first direction is supported on the sheet support surface, the cover is located at the second position and the sheet is supported by the sheet support surface, the guide, and the cover at the second position.

11. The sheet feed device according to claim 1, wherein the top plate is supported by the housing, and the tray is configured to move relative to the top plate.

12. A sheet feed device comprising:

a housing formed with a first opening and a sheet conveyance path; and a tray configured to be inserted into the housing through the first opening in a first direction and to be pulled out in a second direction opposite from the first direction, the tray being configured to support a sheet, the tray comprising:

a bottom plate configured to support a sheet;

a front plate protruding upward from an end portion of the bottom plate in the second direction; and a cover configured to move between a first position at which the cover closes a second opening and a second position at which the cover opens the second opening, the second opening being defined by an end of a top plate in the second direction and an upper end of the front plate, the top plate covering an upper side of a space that accommodates a sheet, wherein the cover includes:

a first plate rotatably supported by the front plate; and a second plate supported by the first plate so as to move between:

a third position at which the second plate overlaps the first plate; and a fourth position at which the second plate protrudes from a distal end of the first plate in a radial direction of rotational movement of the first plate.

13. A sheet feed device comprising:

a housing formed with a first opening and a sheet conveyance path; and a tray configured to be inserted into the housing through the first opening in a first direction and to be pulled out in a second direction opposite from the first direction, the tray being configured to support a sheet, the tray comprising:

a bottom plate configured to support a sheet;

a front plate protruding upward from an end portion of the bottom plate in the second direction; and a cover configured to move between a first position at which the cover closes a second opening and a second position at which the cover opens the second opening, the second opening being defined by an end of a top plate in the second direction and an upper end of the front plate, the top plate covering an upper side of a space that accommodates a sheet, wherein both end portions of a surface of the cover in a width direction are located at a higher position than a center portion of the surface in the width direction, the width direction being perpendicular to the first direction and parallel to a sheet support surface of the bottom plate, the surface facing upward when the cover is at the second position.

* * * * *